United States Patent [19]

Finsterwalder

[11] 4,097,948

[45] Jul. 4, 1978

[54] FLOATING ROADWAY ASSEMBLY FOR ROAD VEHICLES

[75] Inventor: Ulrich Finsterwalder, Munich, Germany

[73] Assignee: Dyckerhoff & Widmann Aktiengesellschaft, Munich, Germany

[21] Appl. No.: 713,534

[22] Filed: Aug. 11, 1976

[30] Foreign Application Priority Data

Aug. 16, 1975 [DE] Fed. Rep. of Germany ..... 2536442

[51] Int. Cl.[2] ..... E01D 15/14

[52] U.S. Cl. ..... 14/27; 61/48; 114/263

[58] Field of Search ..... 14/27, 1, 2.6, 69.5; 61/48; 114/0.5 BD

[56] References Cited

U.S. PATENT DOCUMENTS

| | | | |
|---|---|---|---|
| 407,422 | 7/1889 | Stewart | 14/27 |
| 1,583,638 | 5/1926 | Zadigian | 61/48 |
| 1,900,319 | 3/1933 | Vermeulen | 61/48 |
| 2,080,124 | 5/1937 | Friberg | 404/70 |
| 2,157,959 | 5/1939 | Knight | 14/27 |
| 2,892,433 | 6/1959 | Walker | 14/27 X |
| 3,022,759 | 2/1962 | McCall | 61/48 X |
| 3,091,203 | 5/1963 | Usab | 61/48 X |
| 3,276,209 | 10/1966 | Mosdell | 61/5 |
| 3,306,053 | 2/1967 | Fulton | 61/48 |

*Primary Examiner*—Nile C. Byers
*Attorney, Agent, or Firm*—Toren, McGeady and Stanger

[57] ABSTRACT

A floating roadway assembly adapted to support road vehicles is formed from a plurality of pontoons consisting of concrete material and connected together by a plurality of elongated metal carrying rods which extend longitudinally through each of the pontoons to join them together to form the roadway. The rods are resistant to traction and pressure and the connection between the rods and each of the pontoons is made so as to enable relative movement therebetween longitudinally of the rods.

10 Claims, 7 Drawing Figures

FLOATING ROADWAY ASSEMBLY FOR ROAD VEHICLES

BACKGROUND OF THE INVENTION

The present invention relates generally to floating roadways capable of supporting road vehicles and more particularly to an assembly forming a floating landing bridge which consists of a floats arranged one adjacent the other and connected together throughout the extent of the roadway.

Roadways of the type to which the present invention relates are appropriately utilized where existing harbor facilities are not sufficient to enable the loading and unloading of cargo ships in adequate time. Under such conditions it is usually necessary to construct provisional mooring places in rather short periods of time so that the seagoing vessels may readily unload their cargo without requiring that they be moored or docked at the permanent harbor facilities. Thus, since coastal area ships are capable of anchoring almost anywhere it is usually possible to unload such ships from points outside of the permanent harbor facilities if a floating roadway or other suitable structure is provided to extend between the harbor and the ship thus enabling road vehicles to travel between the two points.

Floating bridges consisting of individual steel pontoons arranged one adjacent the other are known. When such pontoons are rigidly connected together, single loads such as wheel loads of road vehicles are indeed distributed over several adjacent pontoons. However, the bending moments which occur due to the load transmission to several of the pontoons will be extremely great and as a result the forces which must be transmitted by the connecting means between the pontoons become rather large. A movable connection such as an intermediate bridge placed on adjacent pontoons operates to effect load distribution in such a manner that the loads which are applied are absorbed only by the pontoons which are actually loaded. Thus, since bending moments cannot be transmitted by the movable connections such transmission is avoided. Accordingly, load transmission between the pontoons does not occur. As a result the loads which are applied must be limited to loads not greater than that which can be absorbed by the respective directly loaded pontoons.

The present invention is directed toward the provision of a floating roadway, particularly one which is useful as a floating landing bridge, consisting of individual floats so connected together that in a simple and safe manner the loads of the floats may be distributed over a relatively large length of the roadway thus enabling loads to be carried which will exceed the carrying capacity of an individual single float or pontoon.

SUMMARY OF THE INVENTION

Briefly, the present invention may be defined as a floating roadway assembly adapted to support road vehicles comprising a plurality of pontoons consisting of concrete material, a plurality of elongated metal carrying rods extending longitudinally through each of the pontoons to join them together to form the roadway, the rods being resistant to traction and pressure, and means joining the rods to each of the pontoons in a manner to enable relative movement therebetween longitudinally of the rods.

In accordance with the invention, the floats or pontoons are made of steel concrete or prestressed concrete with the elongated metal carrying rods being steel rod-shaped members resistant to tensile stress and pressure which pass through the pontoons with longitudinal mobility. The carrying rods are arranged expediently within the region of the upper half of each of the pontoons. The rods may be joined in the region of the pontoons and secured there relative to each pontoon. In the side walls of each of the pontoons traversed by the carrying rods there is expediently provided a cutout portion within which the carrying rods freely lie and wherein they are secured relative to the end walls of the cutouts extending perpendicularly to the carrying members or rods.

The carrying rods may expediently consist of steel rods having hot-rolled ribs lying in a helical formation thereabout in order to form a partial thread. In the cutouts of the pontoons, the carrying rods may be joined together by coupling means.

In order to maintain the longitudinal mobility or relative longitudinal movement between the carrying rods and the pontoons, the carrying rods are expediently guided in pairs of encasing tubes arranged one within the other and displaceable relative to each other in the longitudinal direction of the rods. An annular cavity formed between each of the carrying rods and the inner encasing tube may be tamped or filled with cement grout or the like. Packing of elastic material such as rubber or plastic may be arranged between each of the pontoons in the region around the point at which each of the carrying rods extends from one pontoon to the other.

The basic advantages of the invention arise essentially by virtue of the fact that due to the overall construction and arrangement of the invention the individual pontoons are essentially elastically interconnected. Accordingly, between any two adjacent pontoons, only one of which may be loaded, only the difference in the bending forces and not their entire magnitude must be absorbed in addition to the transverse force. The bending forces consisting of pressure and traction are distributed to the carrying members rather than to the steel concrete of the pontoons. Therefore, it is appropriate to utilize as the carrying members relatively thick steel rods which may be used both as compression rods and as tension rods and which are threaded so that they may be secured relative to the pontoons by threaded nuts and spliced with threaded couplings. Due to the greater elasticity of the steel carrying rods compared with a rigid connection of steel concrete pontoons, the bending moment in the region of the union or juncture of the pontoons will be lowered to approximately 60%. By the anchoring of only a partial force instead of the total force, the anchor force is additionally lowered to about one-half.

The carrying members or rods of steel are able to transmit transverse forces between two adjacent pontoons. For this purpose they should be designed to have as little play as possible in the vertical direction. This may be achieved by virtue of the fact that the rods are guided in two mutually displaceable encasing tubes with the annular cavity between the carrying rod and the inner encasing tube being filled with a hardened material such as cement mortar. Thus, the carrying rods are secured against the inner encasing tube while the outer encasing tube may be laid or embedded within the concrete of the pontoon and fixedly mounted relative thereto.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
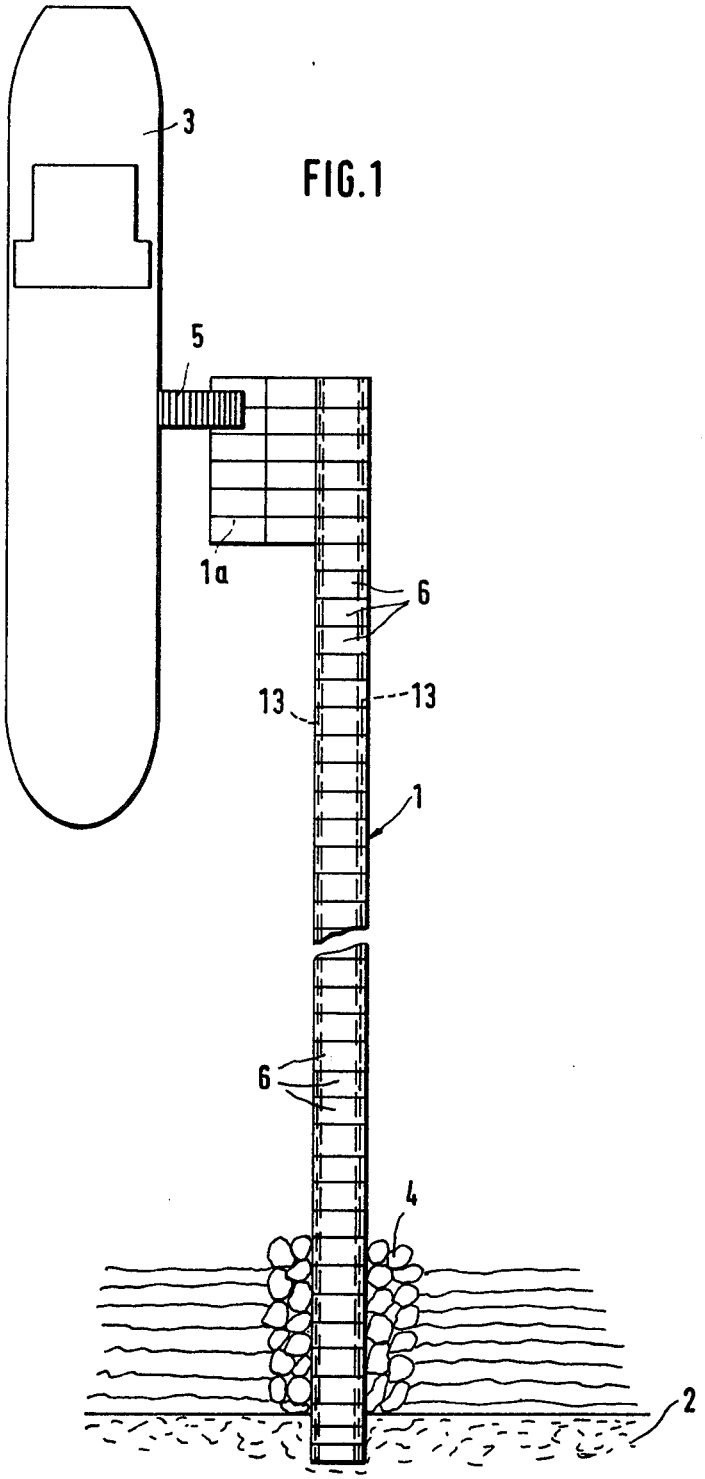
FIG. 1 is a top plan view of a floating roadway or landing bridge assembly formed in accordance with the present invention.

Referring now to the drawings, wherein like reference numerals refer to similar parts throughout the various figures thereof, there is shown in FIG. 1 a general top plan view of a landing bridge or floating roadway assembly which establishes vehicle communication between a shore region 2 and a ship or vessel 3. In order to provide some degree of protection and added support for the floating roadway 1 the surf region at the coast line from which the roadway 1 extends is provided with large stones or tetrapods 4 of steel concrete which extend from the shore region 2. At its side or end remote from the shore region 2, the landing bridge or roadway 1 is enlarged so as to form a platform area 1*a* from which a ramp 5 constructed in a conventional manner provides access to the holds of a ship or other vessel 3.

Figure 2:
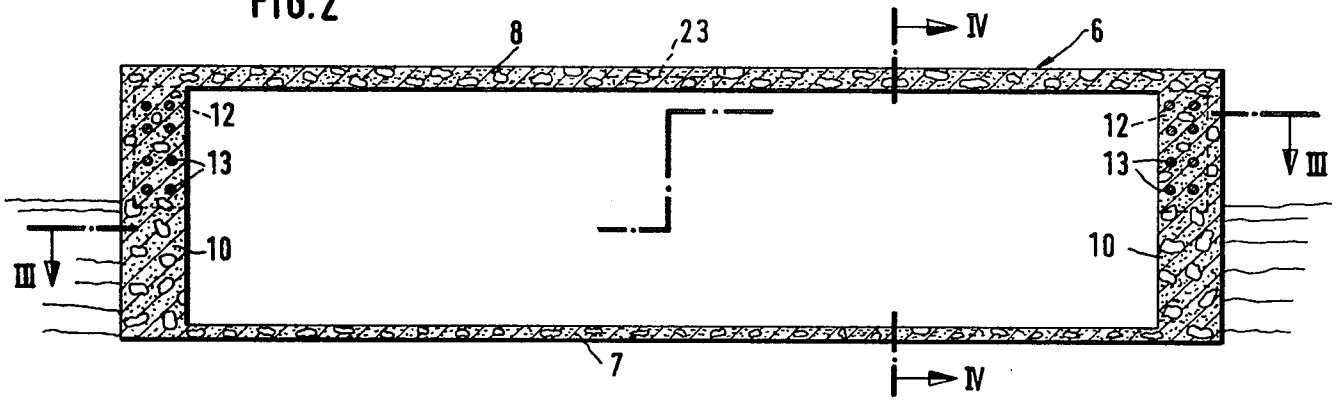
FIG. 2 is a sectional elevation taken across the roadway of FIG. 1 and extending through one of the pontoons thereof.
Figure 4:
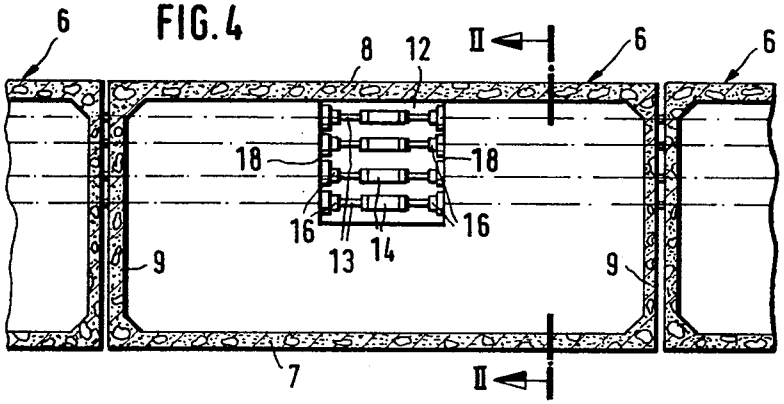
FIG. 4 is a sectional view taken through one of the pontoons longitudinally of the roadway along the line IV—IV of FIG. 2.
Figure 3:
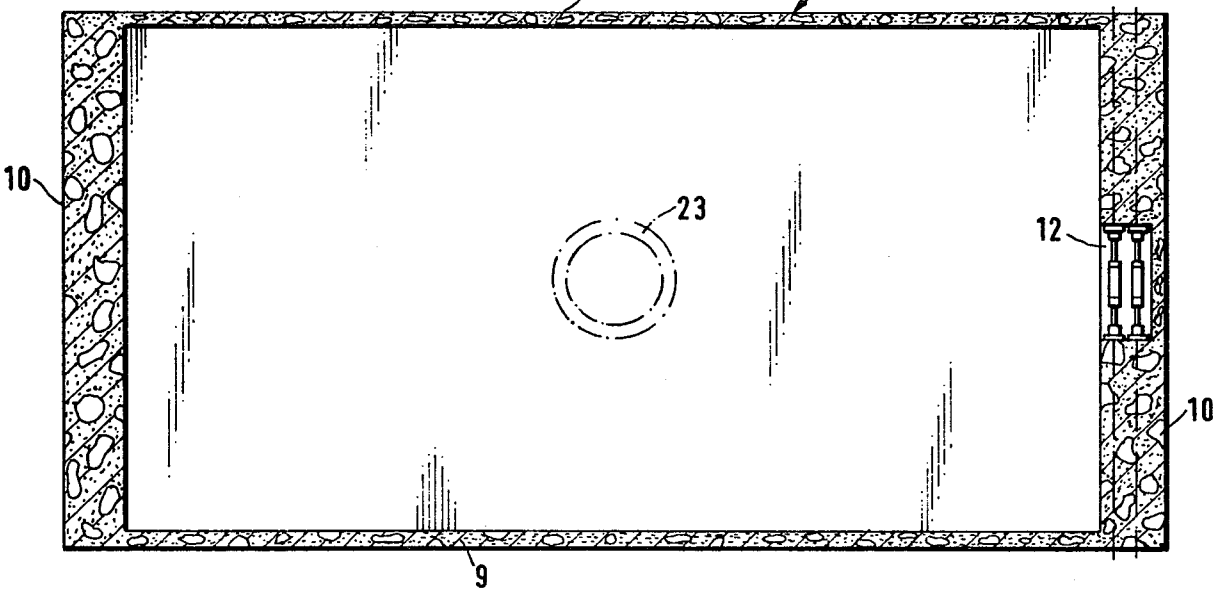
FIG. 3 is a generally horizontal view taken along the line III—III of FIG. 2.

The landing bridge 1 is composed of a number of pontoons 6 which may be made of steel concrete. The pontoons 6 are shown in greater detail in FIGS. 2–4. The pontoons 6 are formed as square blocks with a bottom plate 7, a cover plate 8 longitudinal walls 9 and end walls 10. The end walls 10 are generally thicker than the longitudinal walls 9 and in the upper region thereof line above the water line the walls 10 are formed with a cutout 12. Within the cover plate 8 there may be arranged a passage opening 23.

The pontoons 6 are joined together by carrying members or rods 13 which extend longitudinally along the length of the bridge or roadway 1 on opposite sides thereof. The carrying rods 13 extend through the end walls 10 of the pontoons 6 and are embedded therein. Thus, it will be seen that the carrying rods 13 penetrate through the end walls 10 and through the cut out portions 12 on opposite sides of each pontoon and extend within the region of the end walls 10 lying above the water line. The carrying members 13 may be formed of steel rods having hot-rolled ribs 11 lying in a helical arrangement thereabout in order to form a partial thread thereon.

In order to maintain the longitudinal mobility, or relative longitudinal movement between the rods 13 and the pontoons 6, the rods 13 are arranged within the interior of the end wall 10 to extend within a pair of encasing tubes 19 and 20 which are made of plastic material. The encasing tubes 19 and 20 are arranged concentrically with each other with the tubes being longitudinally displaceable or movable relative to each other.

The annular space defined between the steel rod 13 and the inner encasing tube 20 is tamped or filled with a hardening material such as cement mortar 21. Thus, the steel rods 13 are affixed in the transverse direction relative to the end wall 10 of the pontoon 6 so that transverse forces may be transmitted from one pontoon to the next. The longitudinal mobility of the steel rods 13 relative to the pontoons 6 is achieved in that each of the steel rods 13 forms a unit with the respective inner encasing tube 20 and the tamping material 21 which may expand as a whole and shift in relation to the respective outer encasing tube 19 which is embedded or firmly affixed in the concrete of the pontoon end wall 10.

Figure 5:
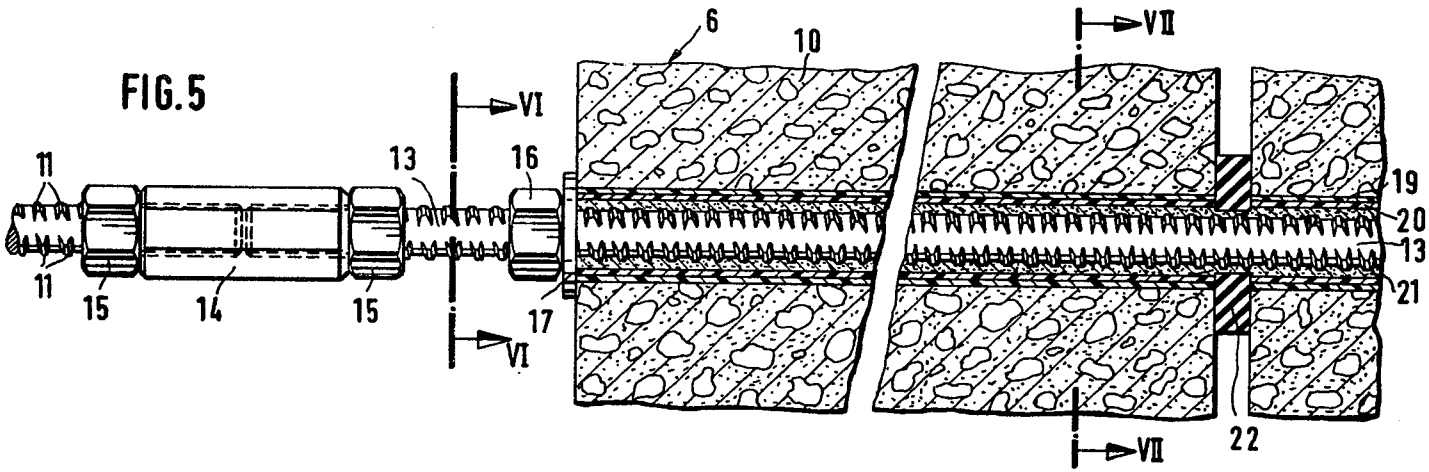
FIG. 5 is a more detailed view partially in section taken generally longitudinally of the roadway and showing portions of the pontoons through which the carrying rods extend with the juncture between two pontoons being depicted.
Figure 7:
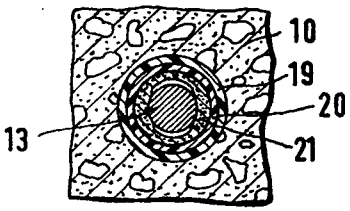
FIG. 7 is a sectional view taken along the line VII—VII of FIG. 5.
Figure 6:
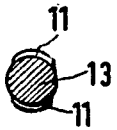
FIG. 6 is a sectional view taken along the line VI—VI of FIg. 5.

As best in seen in FIG. 5, the carrying rod 13 extends from one pontoon 6 to another with the spacing or interspace between the two pontoons 6 within the region surrounding the steel rod 13 being sealed by seal rings 22 made of soft rubber.

Within the region of the cut outs 12, the steel rods 13 are joined together by couplings 14 and lock nuts 15 which are best seen in FIG. 5. The steel rods 13 are secured against the opposite end walls 18 of the cut out region 12 by nuts 16 and washers 17. However, this is accomplished without obtaining a bracing of adjacent pontoons which is prevented by the seal rings 22. The individual pontoons are thus strung on the steel rods 13 an though upon an elastic steel band.

With pontoons 6 having dimensions of approximately 9.0 m in length by 4.5 m in width and with a height of 2.3 m, the weight of the pontoons will be no more than about 50 t so that the pontoons will not exceed the carrying capacity of a normal ship crane. The special linking of the pontoons 6 makes it possible for vehicles weighing up to 100 t to travel along the floating landing bridge. The sag under load of the bridge will then be about 0.27 m, and the transvers inclination for a usual 32-ton semi-trailer when one of the two lanes of the bridge is loaded will be about 1.30%.

The pontoons 6 may be produced at any point in the vicinity of the coast line and they may be transported to their destination either singly or already assembled as a floating landing bridge. As the bridge may be pulled out of the water with a force of about 100 t engaging at one end in a vertical direction, without suffering inadmissible tensions, it can be pulled to land upon a sandy beach with a moderate horizontal force to establish a connection from the ship to the land.

While specific embodiments of the invention have been shown and described in detail to illustrate the application of the inventive principles, it will be understood that the invention may be embodied otherwise without departing from such principles.

What is claimed is:

1. A floating roadway assembly adapted to support road vehicles comprising a plurality of pontoons consisting of concrete material, a plurality of elongated metal carrying rods extending continuously longitudinally through each of said pontoons to join said pontoons together to form said roadway, said rods being resistant to traction and pressure, and means joining said rods to each of said pontoons to enable relative movement therebetween longitudinally of said rods, said means joining said rods to each of said pontoons comprising a pair of concentrically arranged encasing tubes with one of said encasing tubes being located within the other of said encasing tubes, said encasing tubes being longitudinally displaceable relative to each other, with said carrying rods being located within said one inner encasing tube.

2. An assembly according to claim 1 wherein said pontoons are made of steel reinforced concrete.

3. An assembly according to claim 1 wherein said pontoons are made of prestressed concrete.

4. An assembly according to claim 1 wherein said pontoons are formed with an upper and lower region and wherein said carrying rods are arranged to extend within the region of the upper half of said pontoons.

5. An assembly according to claim 1 wherein said carrying rods consist essentially of steel rods which are provided with hot-rolled ribs extending in a helical pattern thereabout and forming a partial thread thereon.

6. An assembly according to claim 1 wherein an annular spacing is formed between said carrying rods and said inner encasing tube said assembly further including cement grout tamped within said annular space to affix said carrying rods to said inner encasing tube.

7. An assembly according to claim 1 wherein said plurality of pontoons are formed with a spacing between adjacent pontoons with each of said carrying rods extending from one pontoon to an adjacent pontoon through said spacing, said assembly further comprising packing means formed of elastic material arranged within said spacing between said pontoons in the region around said carrying rods.

8. A floating roadway assembly adapted to support road vehicles comprising a plurality of pontoons consisting of concrete material, a plurality of elongated metal carrying rods extending continuously longitudinally through each of said pontoons to join said pontoons together to form said roadway, said rods being resistant to traction and pressure, and means joining said rods to each of said pontoons to enable relative movement therebetween longitudinally of said rods, said pontoons including end walls on either side thereof which extend longitudinally of said roadway assembly with each of the end walls on either side of said pontoons being traversed by said carrying rods which extend through said end walls, said end walls including a cutout portion through which said carrying rods extend, said cutout portions having walls on either side thereof defining the limits of said cutout portions with said carrying rods being fixed relative to said terminal walls of said cutout portions.

9. An assembly according to claim 8 wherein said carrying rods are joined at portions thereof extending within said cutout portions of said end walls.

10. An assembly according to claim 8 wherein said carrying rods have terminal ends located within said cut out portions of said end walls and wherein said assembly further includes threaded couplings joining said terminal ends together in said cut out portions.

* * * * *